United States Patent [19]

Brown et al.

[11] 4,403,367

[45] Sep. 13, 1983

[54] YARN PAD

[75] Inventors: Robert S. Brown; John H. O'Neill, Jr., both of Spartanburg, S.C.

[73] Assignee: Miliken Research Corporation, Spartanburg, S.C.

[21] Appl. No.: 293,723

[22] Filed: Aug. 17, 1981

[51] Int. Cl.[3] ..... B24D 13/14; B24D 13/20

[52] U.S. Cl. ..... 15/230.12; 300/21

[58] Field of Search ..... 15/230, 230.12, 230.15, 15/230.17, 246, 230.14; 300/21

[56] References Cited

U.S. PATENT DOCUMENTS

| | | | |
|---|---|---|---|
| 3,075,222 | 1/1963 | Miller | 15/230.12 X |
| 3,413,674 | 12/1968 | Reid | 15/230.12 |
| 3,990,124 | 11/1976 | MacKay et al. | 15/230.12 |

*Primary Examiner*—Chris K. Moore

*Attorney, Agent, or Firm*—George M. Fisher; H. William Petry

[57] ABSTRACT

A yarn pad, for use in conjunction with a circular-style floor cleaning machine, which resists folding or bundling and which is particularly adapted for use with dry-type carpet cleaning systems.

12 Claims, 2 Drawing Figures

YARN PAD

Figure 1:
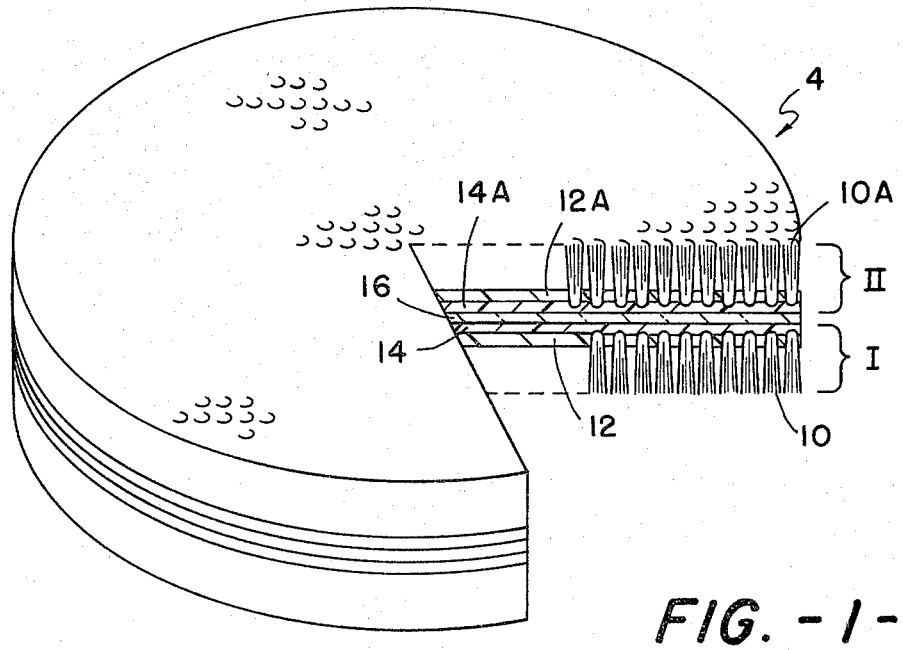

This invention relates to a yarn pad to be used in conjunction with floor covering cleaning or polishing machines which clean by means of a horizontally-oriented circular motion. This yarn pad is particularly suited for use in cleaning floor carpet wherein a dry-type carpet cleaning material is used.

It is known in the prior art to utilize a relatively absorbent pad of woven or non-woven textile material for the purpose of cleaning or scrubbing carpet-type floor coverings, as well as cleaning or polishing floor coverings which present a smooth, hard finish, such as rubber or plastic floor tile, hardwood, slate, etc. Such pads, variously known as yarn pads or bonnets, or spin pads or bonnets, while used in overall cleaning of carpeting, have been particularly useful in cleaning carpet in localized areas of the carpet subjected to heavy or accellerated soiling which require relatively frequent cleaning. Such local or "spot" cleaning is commonly accomplished by applying a cleaning agent, generally a liquid cleaning agent, to the carpet. The cleaning agent is then worked into the soiled area of the carpet by a relatively soft pad comprised of natural or synthetic textile fibers. This pad is used with a floor cleaning machine which is designed to spin a brush or pad in a plane parallel to the floor being cleaned. The pad, usually circular in shape and roughly matched to the diameter of the brush on the floor cleaning machine, is placed between the brush on the machine and the floor. The brush bristles penetrate the top surface of the pad and functionally attach it to the brush; as the brush rotates, the yarn pad rotates as well. The pressure applied by the weight of the machine is sufficient to ensure contact between at least the upper portion of the soiled carpet pile, where most of the soil is likely to be found, and the moving fibers of the pad. In this way, distribution of the liquid cleaning agent among the soiled carpet fibers is promoted. Additionally, the pad serves a second important function of absorbing the soil which has been dissolved or emulsified by the cleaning agent. By being able to scrub and distribute the cleaning agent, as well as absorb and remove the soil acted upon by the cleaning agent, it is frequently possible to clean effectively an area of soiled carpet merely be applying a cleaning agent, and making a single pass over the area with a floor cleaning machine equipped with a yarn pad, without the need for further drying or vacuuming.

Yarn pads of the prior art have been found to be unsatisfactory in several respects when used in this application. It is customary to construct such yarn pads by first forming a circular-shaped substrate or backing material from a woven or non-woven textile material, for example, open-weave polypropylene. Numerous yarn loops or yarn segments of one or more lengths are then tufted or otherwise attached to the backing material and secured by sewing, or by application of an adhesive to the yarn at or near the point of attachment to the backing material.

Because the cleaning liquid in wet-type cleaning systems is frequently applied through the yarn pad onto the carpeting beneath the yarn pad, the backing material is often of an open weave, or is otherwise made to facilitate passage of liquid, as well as to facilitate open-air drying of the yarn pad after washing. The yarn pad is often expected to absorb considerable amounts of liquid in the course of cleaning a carpet using a liquid cleaning agent, which also makes rapid, effective drying of the pad after use important. The yarn loops are commonly installed in a way which promotes passage of liquid through the pad, as, for example, by grouping the attachment points of the yarns into a number of concentric circles on the pad, with relatively large areas of exposed open weave or porous backing material between the attachment points of the yarn groups in one circle and those points associated with yarn groups in an adjacent circle.

Such construction typically results in a yarn pad which is quite pliant—so much so, that a pad of this construction usually cannot support itself if supported at only a single point. A disadvantage of this pliability is evident when the friction between the carpet surface and the yarn pad surface exceeds the gripping power of the brush bristles used to attach the yarn pad to the floor cleaning machine. The resulting slippage of the pad on the brush results in a folding or creasing of the yarn pad under the machine, thereby disrupting the even cleaning action of the pad and causing an imbalance in the rotational motion of the pad. When this occurs, it is necessary to stop the machine and manually re-orient the pad on the brush, since continued rotation of the folded pad in the direction of the fold will eventually cause more of the pad to become disengaged from the supporting brush.

Such folding of the yarn pad in use occurs frequently when cleaning agents in liquid form are used. However, it has been found that with the development of cleaning agents in powdered form, leading to so-called "dry" cleaning systems, the problem is aggravated. It is believed that when powdered cleaning agents, for example, of the type disclosed in U.S. Pat. No. 4,013,594, are used, the friction reducing effects of having a cleaning liquid present in the interface between the carpet fibers and the yarn of the yarn pad are lost. As a result, the flexible yarn pads of the prior art, when used with a dry-type carpet cleaning agent, such as disclosed in U.S. Pat. No. 4,013,594, exhibit a marked tendency to fold or bundle under the floor cleaning machine, making the use of such pads with cleaners of this general type impractical.

The limited number of prior art devices which have attempted to alleviate this problem have been generally unsuccessful, because of the difficulty in developing a yarn pad which is sufficiently rigid to resist the increased frictional forces generated by the dry-type cleaner and remain evenly attached to the brush, yet which has a backing material and overall construction which promotes complete and thorough drying of the pad after the soiled pad has been washed. Attempts at developing such a pad have resulted in either a pad which continues to fold and bundle, or a pad which resists drying and therefore promotes mildew, rot, etc.

This invention solves the above-mentioned problem of yarn pads which fold or bundle when subjected to frictional forces between the pad and the carpet fibers being cleaned, and furthermore has the advantage of being easy to dry thoroughly and completely. The yarn pad of this invention is of relatively simple construction, and may be manufactured on machinery primarily used in the manufacture of carpets. Furthermore, this yarn pad may be used in many cases with both wet and dry-type cleaning agents.

An additional factor is present in using dry-type cleaners. Because of the relative increase in friction due to a lack of liquid cleaning agent to act as a lubricant, brushes associated with typical floor cleaning machines and intended for use with liquid type cleaning agents frequently cannot be used with dry-type cleaning agents without excessive carpet fiber wear. The yarn pad of this invention allows machines with such brush types to use the advantageous dry cleaning systems without excessive carpet pile abrasion and without a large investment in specialized equipment.

Figure 2:
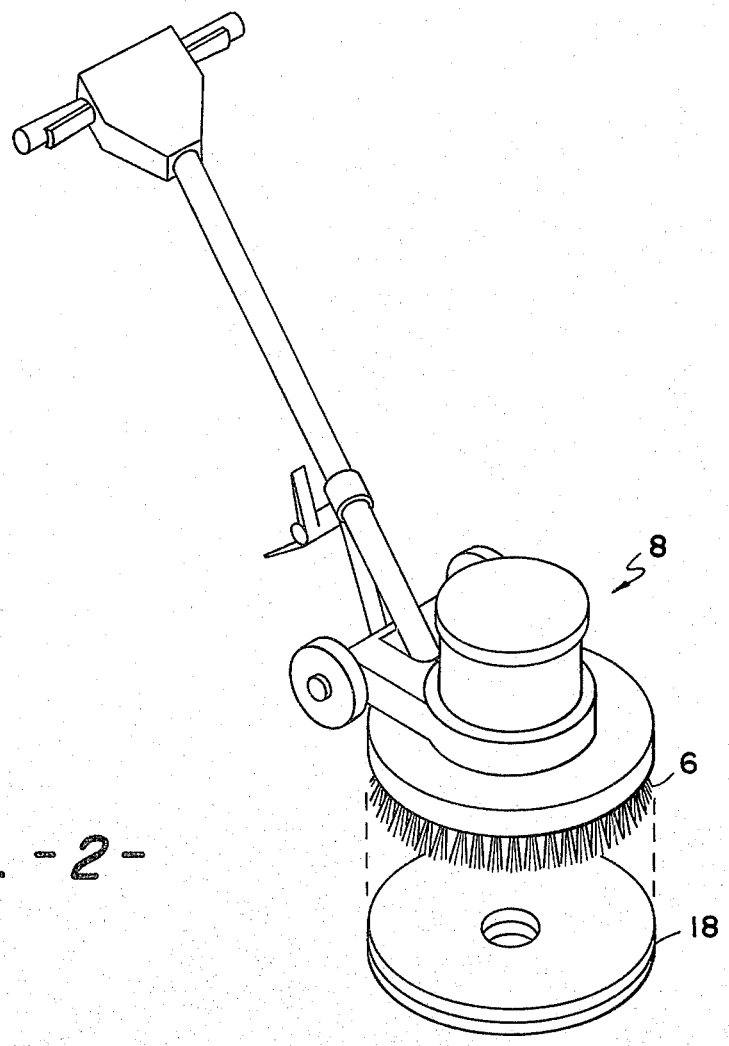

Details of the construction and method of manufacture of this yarn pad are discussed below, in conjunction with the attached figures, in which FIG. 1 represents, in a perspective cut away view, a schematic representation of two embodiments of the present invention;

FIG. 2 shows a floor cleaning machine of a type suitable for use with an annular-shaped pad embodying this invention, and further shows the operable relationship between pad and machine.

Looking at FIG. 1, the pad segment marked I comprises a generally circular section of tufted floor carpet in which a plurality of carpet-type yarns 10 have been looped, in a conventional manner, through a substrate or primary backing 12. Primary backing 12 is then coated with a latex-like material (not shown) and attached thereby to a secondary backing 14, which serves to secure the loops of yarn 10 in place and gives the carpet greater rigidity. The choice of materials for primary backing 12 includes woven and non-woven polypropylene, polyester or nylon, woven jute, or other suitable materials. Secondary backing 14 may comprise leno woven polypropylene, woven jute, vinyl, polyester or other suitable materials. The latex-like material may comprise a styrene butadiene latex, an acrylic latex, or a contact cement. Typically, the carpet yarn 10 used is nylon, although other yarn types such as, for example, cotton, rayon, wool, polyester, polypropylene, or acrylic may be employed if desired. Also, while a looped, tufted construction is discussed above, other construction types, such as woven or fusion bonded constructions, as well as cut pile or loop and cut combinations, may be used as well.

The pad segment marked II in FIG. 1 is also a generally circular section of tufted carpet, having dimension and construction substantially identical to the pad segment marked I; it is intended that this segment be cut from the same larger section of tufted carpet which supplies pad segment I. These two carpet sections are then positioned in aligned, backing-to-backing relationship and a layer of adhesive 16 such as a styrene butadiene or acrylic latex adhesive, or contact cement, is applied therebetween. After pressure is applied and the adhesive is cured, the rear surfaces of secondary backing materials 14 and **14*a* are bonded to each other, resulting in a disc 4 having yarn loops or ends of substantially identical composition, configuration, fiber face weight and density, etc. on each side. This configuration allows for each side, in turn, to be used in contact with soiled areas of the carpet to be cleaned with equal effectiveness, while the opposite, upward-facing side of the yarn pad serves to anchor the pad to the rotating brush of the floor cleaning machine 8 (FIG. 2), via penetration of brush bristles 6**.

An alternative construction can also be depicted by FIG. 1, wherein the fibers **10, 10*a* are secured to a backing 12, 12*a* via an adhesive layer shown at 14, 14*a*. No secondary backing is used. A stiffening member, which may be envisioned at 16 in FIG. 1, is then used to impart the desired degree of rigidity to the layered composite. For example, a sheet of fiberglass of approximately 0.010 inch thickness may be bonded to the opposing adhesive layers 14, 14*a***, resulting in a yarn pad having the desired characteristics.

The yarn pad 18 depicted in FIG. 2 is an embodiment of generally annular shape, intended to prevent needless wear and twisting of fibers near the center of the pad.

Aside from the benefits this desirable symmetry has in terms of convenience and efficiency, this construction has been found to impart a nearly ideal degree of face fiber density and rigidity to the yarn pad for use with dry-type cleaning agents. The pad, which is sufficiently rigid to avoid the folding and bundling so common with yarn pads of conventional design, is well suited for use with carpet cleaning agents which generate higher frictional forces than typical liquid-type carpet cleaning agents, when used with floor cleaning machines of the type herein described (See, for example, FIG. 2 at 8). A pad constructed in accordance with this invention is found to dry readily and completely after washing, and does not present problems in retaining moisture, in fostering the growth of undesirable microorganisms, etc. In addition, the yarn pad of this invention provides for easy adaptation of existing floor cleaning machines to cleaning systems using dry-type cleaning agents, and is also suitable for use with wet-type cleaning systems in which the cleaning liquid is dispensed onto the carpeting ahead of, or immediately surrounding, the yarn pad.

The following examples are provided to illustrate certain preferred embodiments more fully, and are not intended to be limiting.

EXAMPLE I

A woven substrate approximately 0.040 inches in thickness and woven from polypropylene strips approximately 0.03 to 0.06 inches wide in a regular weave of 11 picks per inch with an 11 pick warp is used as the primary backing material. A three ply yarn totaling 1320 deniers and comprised of DuPont Antron® nylon having a filament denier of 34 is tufted into the backing material, resulting in a loop pile height of approximately 0.85 inches on the tufted side, a total fiber density of approximately 44 ounces per square yard, and an exposed fiber weight (above backing) of approximately 36 ounces per square yard. A layer of latex comprising approximately 100 parts (by weight) of styrene butadiene resin, 100 parts (by weight) of a calcium carbonate filler, and small amounts of defoaming agents, stabilizers, and thickening agents is then applied to the primary backing material, on the side opposite the tufted side, to a thickness of approximately 22 ounces per square yard. The latex has a viscosity in the range of 5000 cps. A second layer of latex, of thickness approximately 10 ounces per square yard, is applied to the previously coated latex layer; this latex is comprised of 100 parts (by weight) of styrene butadiene, 350 parts (by weight) of a calcium carbonate filler, and small amounts of other ingredients as above. This latex has a viscosity in the range of 16,000 cps. The secondary backing material is marketed by Patchogue Plymouth, of 550 Interstate North, Atlanta, Ga., 30339, under the name Action Back; it is a leno weave polypropylene-like material having a weight of approximately 2.9 ounces per square yard. This backing material is applied to the latex coating, and the combination is cured at approximately 325° F. for 10 minutes. An adhesive, acrylic latex contact cement, is applied to the exposed backing of each of two sections of the tufted product obtained above, and the two sections are pressed lightly together in back-to-back orientation with tufts facing outwardly, until the adhesive is cured. A circular die is used to cut the yarn pad from this composite.

EXAMPLE II

A three ply yarn totaling 1320 deniers and comprised of acrylic fibers having a filament denier of 34 is woven such that it has a cut pile height of approximately 0.85 inches and a total fiber density of approximately 39 ounces per square yard, and an exposed fiber weight (above backing) of 31 ounces per square yard. A layer of latex comprising approximately 100 parts of styrene butadiene resin, 350 parts of a calcium carbonate filler, and small amounts of defoaming agents, stabilizers, and thickening agents is then applied to the back of the woven carpet, on the side opposite the tufted side, to a thickness of approximately 32 ounces per square yard. The latex has a viscosity in the range of 16,000 cps. The secondary backing material is as used in Example I, and is applied as in Example I. An acrylic latex contact cement is applied to the exposed backing of each of two sections of the tufted product obtained above, and the two sections are pressed lightly together in back-to-back orientation with tufts facing outwardly, unitl the adhesive is cured. A circular die is used to cut the yarn pad from this composite.

We claim:

1. A circular yarn pad having two composite layers for use on a floor cleaning machine, each of said layers comprising a flat primary substrate material, a plurality of yarn segments having a major proportion of each segment protruding from a first face of said primary substrate material in fixed relation thereto, a secondary backing material secured to a second face of said primary backing material, said second face being opposite from said first face, wherein said layers are securely joined with said backing materials in opposed relation and said first faces of said substrate materials directed in mutually opposite directions.

2. The yarn pad of claim 1 wherein said yarn segments are uniformly distributed over the face of said primary substrate material.

3. The yarn pad of claim 1 wherein said yarn segments are substantially uniform in length.

4. The yarn pad of claim 1 wherein said layers are securely joined by means of a uniform adhesive layer interposed between said backing materials in opposed relation.

5. The yarn pad of claim 1 wherein said yarn segments are in the form of loops extending from said primary substrate material.

6. The yarn pad of claim 1 wherein said yarn segments are comprised of nylon.

7. The yarn pad of claim 1 wherein said yarn pad is annular in shape.

8. A method of manufacturing a layered composite from which yarn pads may be cut, comprising the steps of:

(a) affixing a plurality of yarn segments to protrude from a first face of a first section of substrate material;

(b) securing a backing material to a second face of said first section of substrate material, said second face being opposite said first face;

(c) affixing a plurality of yarn segments to protrude from a first face of a second section of substrate material;

(d) securing a backing material to a second face of said second section of substrate material, said second face being opposite said first face;

(e) affixing said first section of said substrate material and said second section of said substrate material together in backing material opposed configuration, thereby orienting said respective first faces of said first and said second substrate materials in mutually opposite directions and forming a layered composite from which yarn pads may be cut.

9. A method of manufacturing a circular yarn pad comprising the steps of:

(a) affixing a plurality of yarn segments to protrude from a first face of a first section of substrate material;

(b) securing a backing material to a second face of said first section of substrate material, said second face being opposite said first face;

(c) affixing a plurality of yarn segments to protrude from a first face of a second section of substrate material;

(d) securing a backing material to a second face of said second section of substrate material, said second face being opposite said first face;

(e) affixing said first section of said substrate material and said second section of said substrate material together in backing material opposed configuration, thereby orienting said respective first faces of said first and said second substrate materials in mutually opposite directions and forming a layered composite;

(f) cutting said composite into a circular shape.

10. The method of claim 8 or 9 wherein said first and second substrate materials are affixed by application of an adhesive.

11. The method of claim 8 or 9 wherein said yarn segments are affixed uniformly over said respective first faces of said first and second sections of substrate material.

12. The method of claim 8 or 9 wherein a flat stiffening member is interposed between said first section of said substrate material and said second section of substrate material, immediately prior to said affixing of said first and second sections together.

* * * * *